US005529306A

United States Patent [19]

Staats et al.

[11] Patent Number: 5,529,306

[45] Date of Patent: Jun. 25, 1996

[54] GOLF SWING TRAINING DEVICE

[76] Inventors: Theodore J. Staats, P.O. Box 730, Maggie Valley, N.C. 28751; William O. Corder, Jr., 1206 Stonehurst Rd., Anderson, S.C. 29621

[21] Appl. No.: 541,043

[22] Filed: Oct. 11, 1995

[51] Int. Cl.[6] ..... A63B 69/36

[52] U.S. Cl. ..... 473/208; 482/91; 473/212; 473/214; 473/216

[58] Field of Search ..... 273/1887.2, 188 R, 273/189 R, 189 A, 191 B, 191 R, 192; 482/91; 434/252

[56] References Cited

U.S. PATENT DOCUMENTS

| | | | |
|---|---|---|---|
| 1,279,924 | 9/1918 | Smith | 273/189 R |
| 3,109,244 | 11/1963 | Trifaro et al. | 273/189 R X |
| 3,672,682 | 6/1972 | Yanagidaira | 273/189 R |
| 4,892,317 | 1/1990 | Corder, Jr. | 273/189 R X |
| 4,896,887 | 1/1990 | Cable | 273/189 R X |
| 4,960,280 | 10/1990 | Corder, Jr. | 273/189 R X |
| 5,005,836 | 4/1991 | Nelson | 273/191 R |
| 5,040,798 | 8/1991 | Leitao | 273/189 R X |
| 5,085,437 | 2/1992 | Leitao | 273/189 R |
| 5,096,199 | 3/1992 | Wyatt, Jr. et al. | 273/189 R |
| 5,203,567 | 4/1993 | Erlinger et al. | 273/189 R X |
| 5,248,146 | 9/1993 | Viets et al. | 273/189 R |
| 5,257,779 | 11/1993 | Dalbo | 273/189 R X |
| 5,295,690 | 3/1994 | Johnson | 273/189 R X |
| 5,397,122 | 3/1995 | Herridge, II | 273/189 R |

*Primary Examiner*—George J. Marlo
*Attorney, Agent, or Firm*—Carter & Schnedler

[57] ABSTRACT

A golf swing training device which automatically allows any golfer to develop a perfect swing plane, while hitting golf balls, and with minimal instruction. The primary operative mechanism of the device is the maintaining of a substantially constant distance between the left pectoral muscle and the right forearm (assuming a right-handed golfer). The device includes a stick, with elastic bands for connection to the left pectoral muscle and the right forearm. Various alternative connections are disclosed.

7 Claims, 5 Drawing Sheets

GOLF SWING TRAINING DEVICE

BACKGROUND OF THE INVENTION

The invention relates generally to an instructional teaching aid for improving a golf swing and, more particularly, to a teaching aid which enables a golfer, with minimal instruction, to practice and develop a proper golf club swing.

A wide variety of devices have been proposed for aiding a golfer in developing a proper golf swing. Examples, of such devices which can be employed while swinging an actual golf club are disclosed in Cable U.S. Pat. No. 4,896,887; Corder, Jr. U.S. Pat. No. 4,960,280; Leitao U.S. Pat. No. 5,085,437; and Johnson U.S. Pat. No. 5,295,690. Various other devices have been proposed which attempt to teach a proper golf swing without swinging an actual golf club. Examples are disclosed in Trifaro et al U.S. Pat. No. 3,109,244 and Nelson U.S. Pat. No. 5,005,836. In general, such devices rely upon developing "muscle memory" whereby it is intended that the golfer ultimately learns to produce a correct golf swing without the aid of the device.

Nevertheless, the various prior art devices are subject to a number of shortcomings, and there remains a need for an improved golf instructional teaching aid, particularly one which enables a golfer, with minimal or no instruction, to produce a perfect swing plane.

SUMMARY OF THE INVENTION

Accordingly, it is an object of the invention to provide a relatively simple device, which can be employed by virtually any golfer, for self-instruction to develop a proper golf swing.

It is a related object of the invention to assist a golfer in understanding of the mechanics of a proper golf swing.

It is another object of the invention to provide such a training device which can be employed for self-instructional purposes during the actual playing of a round of golf.

It is a related object of the invention to provide such an instructional training device which does not interfere with a proper golf swing, nor with the playing of a round of golf.

It is another related object of the invention to provide such a device which effectively aids in the practice of all golf strokes, including full swing, short swing, chip shots, and putting.

Very briefly, and in overview, the invention is based on a recognition that a perfect swing plane can be created by maintaining the left pectoral muscle and the right forearm of a golfer (assuming a right-handed golfer) a substantially constant distance apart.

The invention provides a golf swing training device which includes an elongated rigid shaft, such as a stick, having two ends. Attached to a first portion of the stick near one end thereof is a relatively larger band, preferably an elastic band, for generally connecting the first portion of the stick to the pectoral muscle of a golfer on the side of the golfer generally facing the intended direction of golf ball travel while the golfer is addressing the ball. In the case of a right-handed golfer, this is the left pectoral muscle. This relatively larger band is sized to extend generally under the armpit and around the neck of the golfer. When thus connected, the stick extends from the first portion generally under the armpit of the golfer towards the one end of the shaft. Attached to a second portion of the stick near the other end thereof is a relatively smaller band for generally connecting the second portion of the stick to a portion of the arm of the golfer on the side of the golfer generally facing away from the intended direction of golf ball travel while the golfer is addressing the ball. In the case of a right-handed golfer, this is the right arm. When in position, the stick extends from the second portion past the connected arm of the golfer towards the other end while the golfer is addressing the ball. The relatively smaller band connects the second portion of the shaft to either the forearm or the upper arm of the golfer, preferably above the arm, for example, on top of the forearm.

In one alternative form, the relatively larger band extends around the chest of the golfer, rather than around the neck. As another alternative, particularly for a golfer working on turning or who has a "flying elbow", the relatively larger band extends generally under the armpit and around the outside of the connected arm of the golfer. As yet another alternative, rather than a band around the chest or neck of the golfer, an upper arm connection band is employed.

Although apparently a simple device, the golf swing training device of the invention somewhat surprisingly provides a number of significant features and advantages which are described hereinbelow under the heading "Detailed Description." As will become apparent, the benefits of the invention are provided through a variety of mechanisms, some relatively subtle.

BRIEF DESCRIPTION OF THE DRAWINGS

While the novel features of the invention are set forth with particularity in the appended claims, the invention, both as to organization and content, will be better understood and appreciated from the following detailed description, taken in conjunction with the drawings, in which:

DETAILED DESCRIPTION

Figures 1, 1A:
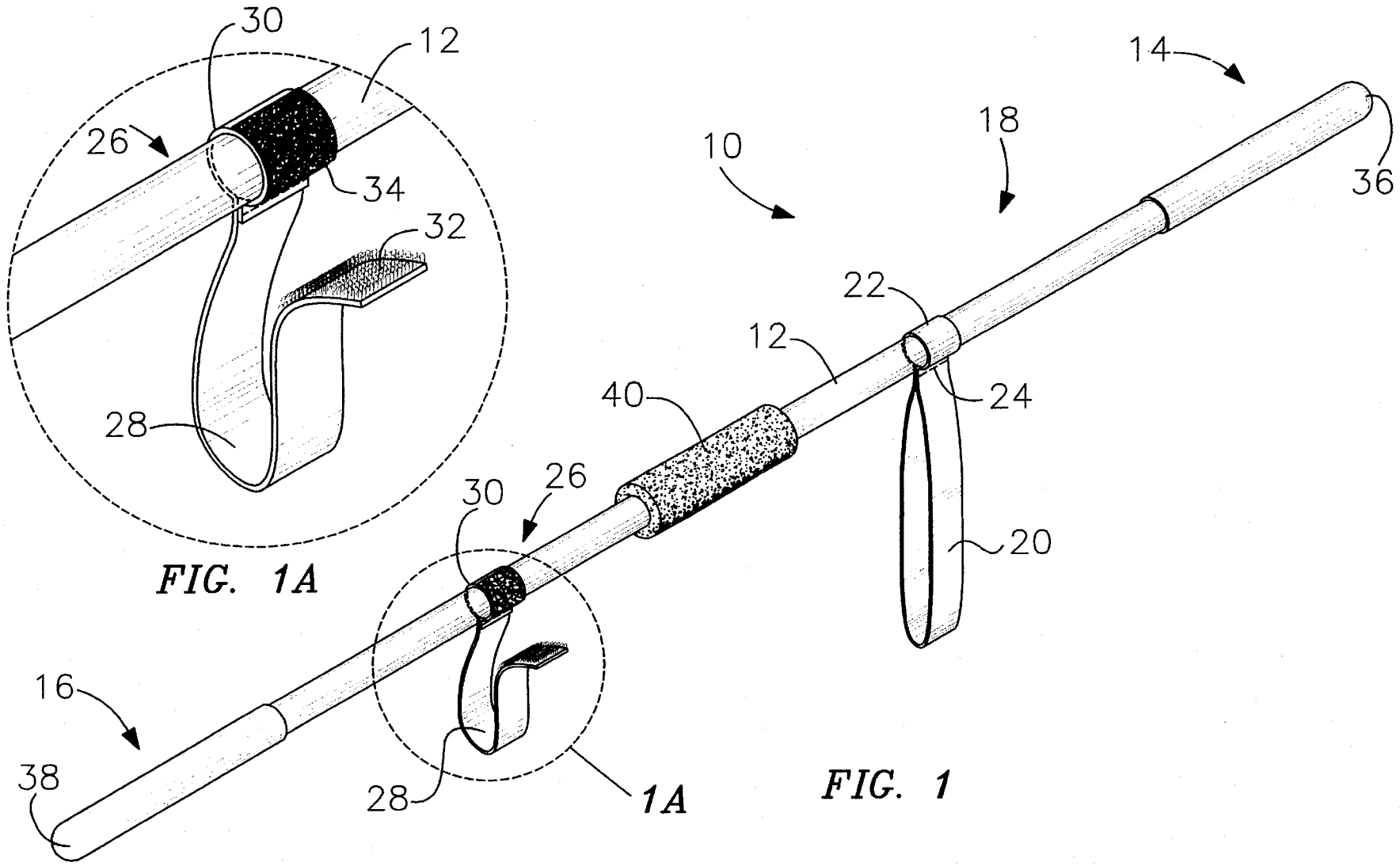
FIG. 1 is a three-dimensional representation of one form of the training device of the invention.
FIG. 1A is an enlarged view of area 1A of FIG. 1.

Referring first to FIGS. 1 and 1A, a golf swing training device 10 includes as a primary element an elongated rigid shaft 12 or stick 12 having two ends 14 and 16. The stick 12 may be made of any suitable material, such as wood, metal, or a composite material, such as fiberglass. Attached to a first portion 18 of the stick 12 near the end 14 is a relatively larger, preferably elastic, band 20 for generally connecting the first portion 18 of the stick 12 to the pectoral muscle of a golfer, as is described hereinbelow in detail with reference to FIGS. 2A through FIG. 8. The relatively larger pectoral connection band 20 is attached to the stick 12 by any suitable means, such as the illustrated attachment loop 22, defined by stitching 24. The smaller loop 22 frictionally holds the relatively larger band 20 at any desired position along the stick 12, but nevertheless permits the relatively larger band 20 to slide along the stick 12 both for initial adjustment purposes, and to accommodate the follow through portion of a golf swing, as is described hereinbelow with reference to FIGS. 5A, 5B and 5C.

Attached to a second portion 26 of the stick 12 near the other end 16 is a relatively smaller band 28 for generally connecting the second portion 26 of the stick 12 to a portion of the arm of the golfer, as is likewise described in greater detail hereinbelow with reference to FIGS. 2A through FIG. 8. The relatively smaller arm connection band 28 is also illustratively attached to the stick 12 by means of a smaller loop 30 which frictionally engages the stick 12, and yet is slidable along the shaft for purposes of initial adjustment and to accommodate relative motion during the follow through portion of a golf swing.

It will be appreciated that the bands 20 and 28 may take a variety of suitable forms to accomplish the intended function. In the illustrated embodiment, the relatively larger pectoral connection band 20 is a simple elastic band, while the relatively smaller arm connection band 28 takes the form of an ordinary strap or belt of nominally non-elastic material, with attachment and adjustment provided and facilitated by hook and loop fastening material comprising complementary hook elements 32 and loop elements 34. However, the relatively smaller arm connection band 28 can also be a simple elastic band.

In any event, it will be appreciated that the connection bands 20 and 28 may be provided in a variety of configurations, without departing from the scope of the invention. For example, although not presently preferred, the stitching 24 can be eliminated, resulting in the relatively larger arm connection band 20 taking the form of a simple elastic loop which is frictionally attached to the stick 12 only when worn by a golfer. The relatively smaller arm connection band 28 can similarly take the form of a simple elastic loop.

Primarily for safety purposes, attached to the ends 14 and 16 are end caps 36 and 38 of any suitable material, such as molded rubber or plastic foam. The end caps 36 and 38 serve to minimize the likelihood of an injury, and additionally serve to prevent the bands 20 and 28 from sliding off the ends 14 and 16, and becoming lost.

For comfort, a chest pad 40 is optionally provided, conveniently of cylindrical configuration, and made of a suitable resilient foam material. The chest pad 40 is slidable along the stick 12, and additionally may serve as a reference point.

Figure 2A:
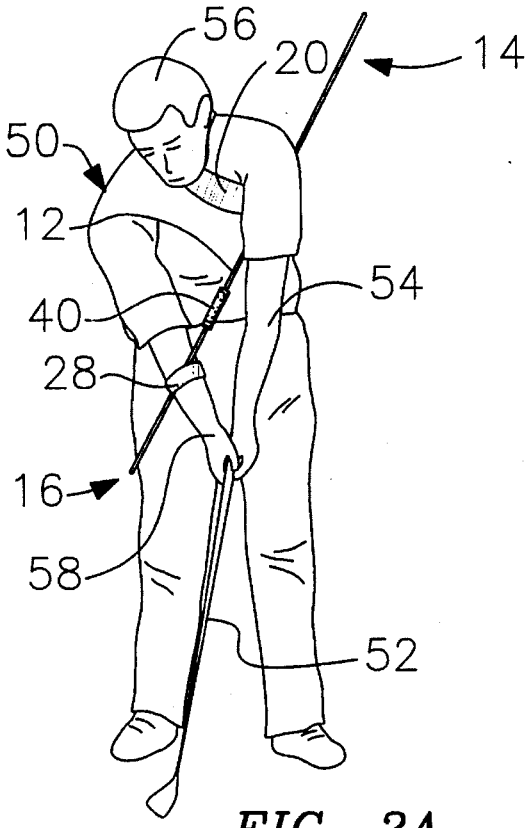
FIGS. 2A, 2B and 2C are views of a golfer in an address position and wearing a training device in accordance with the invention, FIG. 2A being a view facing the front of the golfer generally perpendicular to the direction of intended golf ball travel, FIG. 2B being a view generally from the right side of the golfer looking in the direction of intended golf ball travel, and FIG. 2C being a view generally from the left side of the golfer looking from the intended direction of golf ball travel, an observer in FIG. 2C being just to the side of the intended path of the golf ball.
Figure 2B:
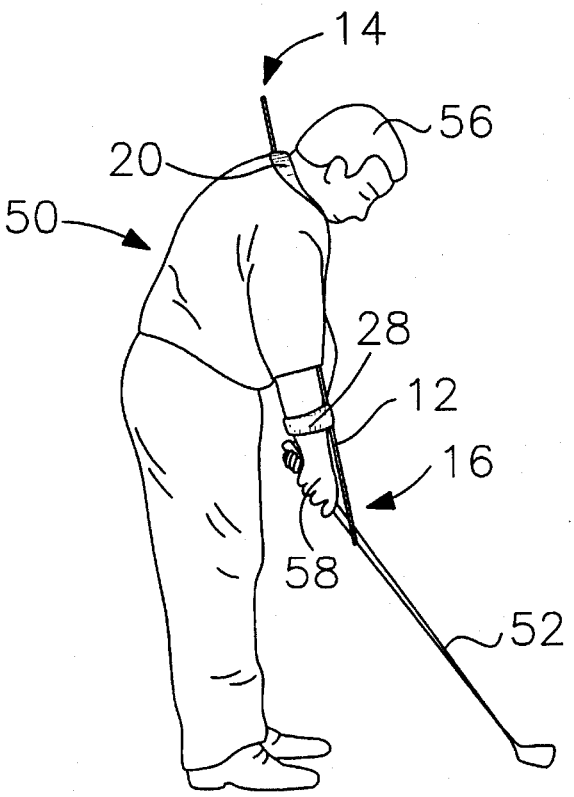
Figure 2C:
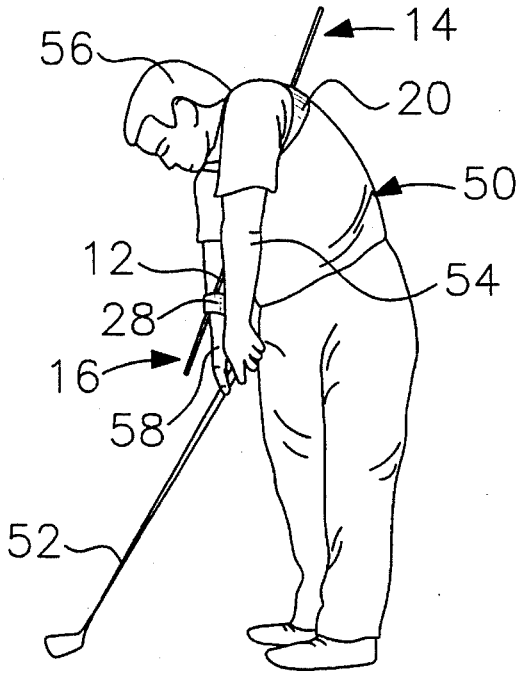

With reference now to FIGS. 2A, 2B and 2C, a golfer 50 holding a golf club 52 is shown at an initial address position and wearing the training device 10 of the invention. It may be noted that, for convenience of illustration, the relatively smaller band 26 is shown in FIGS. 2A, 2B and 2C (as well as in the remaining FIGS. 3 through 9) as a simple elastic band, and attachment details to the stick 12 are not shown. Similarly, for convenience of illustration and description, the golfer 50 is a right-handed golfer. It will be appreciated that, in the case of a left-handed golfer, the words "left" and "right" should be reversed wherever used herein.

To attach the device 10, the golfer 50 first places the left arm 54 through the relatively larger pectoral connection band 20, and then stretches the elastic band 20 to fit over the golfer's head 56, such that the band 20 lies comfortably against the right side of the neck, or collar of the golfer's shirt. The first portion 18 of the stick 12 to which the relatively larger elastic band 20 is attached thus generally is connected to the pectoral muscle of the golfer 18 on the side of the golfer generally facing the intended direction of golf ball travel, that is, the left side of a right-handed golfer, when the golfer 50 is addressing the ball. The stick 12 extends from the first portion 18 generally under the armpit of the golfer 50 towards the end 14. The stick 12 should extend a minimum of seven or eight inches (with no maximum) from the outside edge of the golfer's left armpit.

The second portion 26 of the shaft is connected by means of the relatively smaller band 28 to the right forearm 58 of the golfer 50, preferably approximately five inches above the right wrist, and on top of the forearm 58. The stick 12 extends from the second portion 24 past the connected forearm 58 towards the other end 16. When hitting full shots, the end 16 should extend no more than approximately six inches from the outside of the right forearm 58. When working on a backswing with minimal follow through, the end 16 may extend from six inches to twelve inches, so long as there is a minimum of seven or eight inches of stick 12 extending at the end 14 from the attachment point of the relatively larger band 20.

It will be appreciated that the frictionally engaged sliding attachment of the bands 20 and 28 by means of the smaller loops 22 and 30 (FIG. 1) facilitates adjustment of the device 10 to fit a particular golfer. At the same time, there is sufficient frictional engagement so that the left pectoral muscle and the connected portion of the forearm 58 are maintained a substantially constant distance apart during the takeaway, down swing and impact portions of a golf swing.

When properly applied, the golfer 50 feels downward pressure of the stick 12 applied to the right forearm 16. This downward pressure causes the right forearm 58 to bend slightly at address, and causes the right elbow to collapse on the takeaway, allowing the golfer to feel the correct movement. This same downward pressure on the forearm 58 results in a more consistent downswing motion.

As is perhaps best seen in FIG. 2B, at address, an imaginary line to the intended target of the golf ball should intersect both the lower projecting end of the stick 12 and the shaft of the golf club 52. If the stick 12 varies off this line (whether in or out), the golfer 50 will have an undesirable tendency to force hand rotation in an effort to maintain plane. Proper alignment along the imaginary line also aids the golfer 50 in establishing proper shoulder adjustment.

Considering now the takeaway or backswing portion of a golf stroke, the device of the invention promotes a one-piece takeaway, whereby the hands and club shaft 52 start on a straight line. This promotes a better understanding of achieving a move up the inclined plane through horizontal rotation of the shoulders. When felt by the golfer 50, the club face initially should feel hooded or closed.

Figure 3:
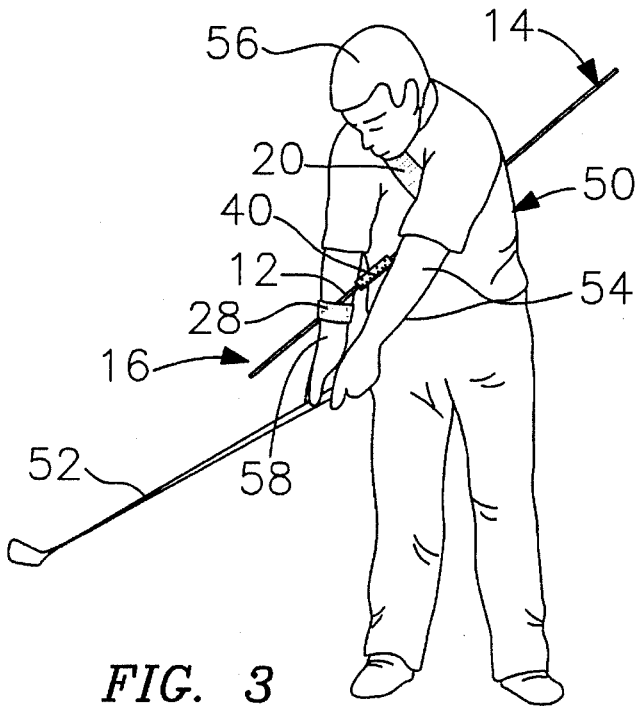
FIG. 3 is a view of the golfer during the takeaway or backswing portion of a golf stroke, wearing the training device of the invention, the view of FIG. 3 being in the same orientation as that of FIG. 2A.

FIG. 3 more particularly illustrates the relative orientation at the beginning of the takeaway portion of a golf stroke, with a constant distance being maintained between the left pectoral muscle of the golfer and the connection point at the right forearm. When the golf club 52 is taken to waist high, the shaft of the golf club 52 and the stick 12 of the device 10 are both generally parallel to the intended target of the golf ball. During the backswing, the golfer's hands and the shaft of the golf club 52 should be on the outside of the portion of the stick 12 extending towards the end 16. The device 10 of the invention does not interfere in any way with proper swinging of the golf club 52.

Figure 4A:
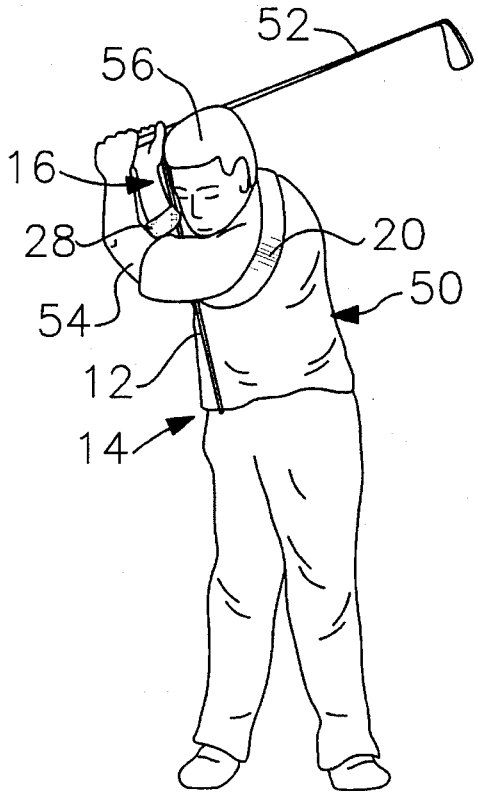
FIGS. 4A, 4B and 4C are views of the golfer in a full backswing position of a golf stroke, still wearing the training device of the invention, the views of FIGS. 4A, 4B and 4C being in the same orientations as those of FIGS. 2A, 2B and 2C, respectively.
Figure 4B:
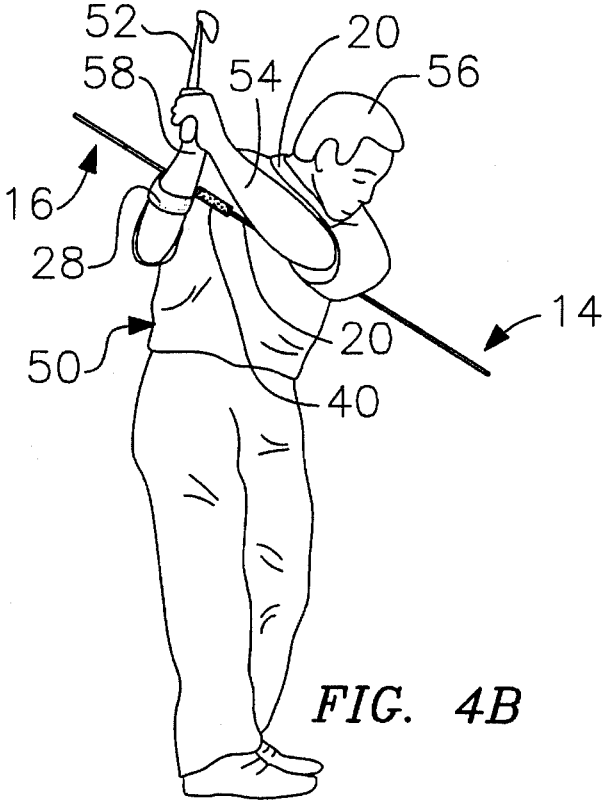
Figure 4C:
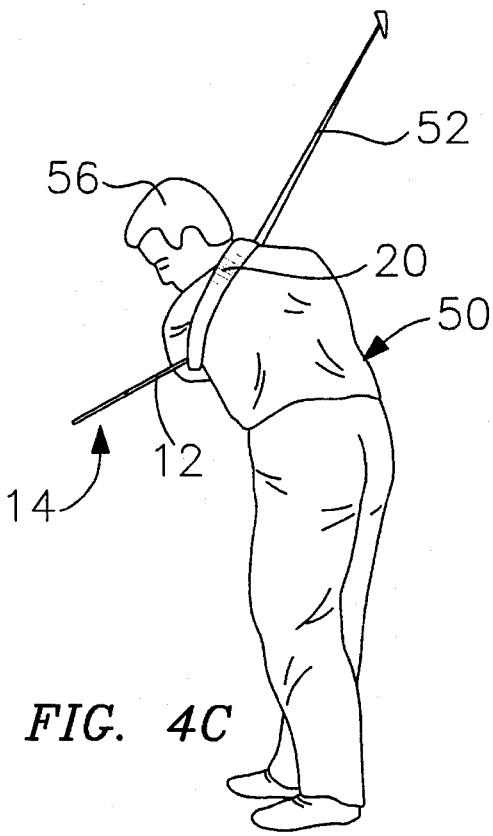

FIGS. 4A, 4B and 4C illustrate a full backswing. Again, the left pectoral muscle and the right forearm of the golfer 50 are maintained a constant distance from each other.

Figure 5A:
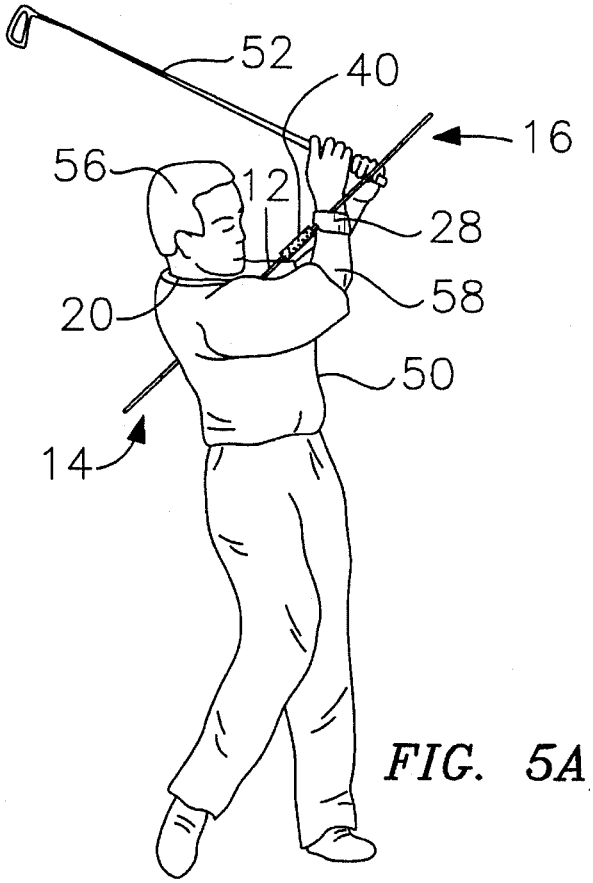
FIGS. 5A, 5B and 5C are views of the golfer with the club in a full follow through portion of a golf stroke and wearing a training device of the invention, the views of FIGS. 5A, 5B and 5C being in the same orientations as those of FIGS. 2A, 2B and 2C, respectively.
Figure 5B:
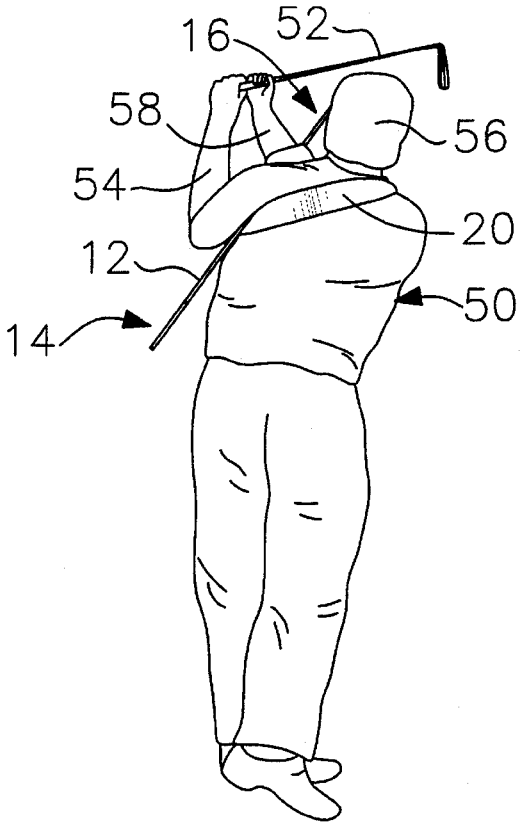
Figure 5C:
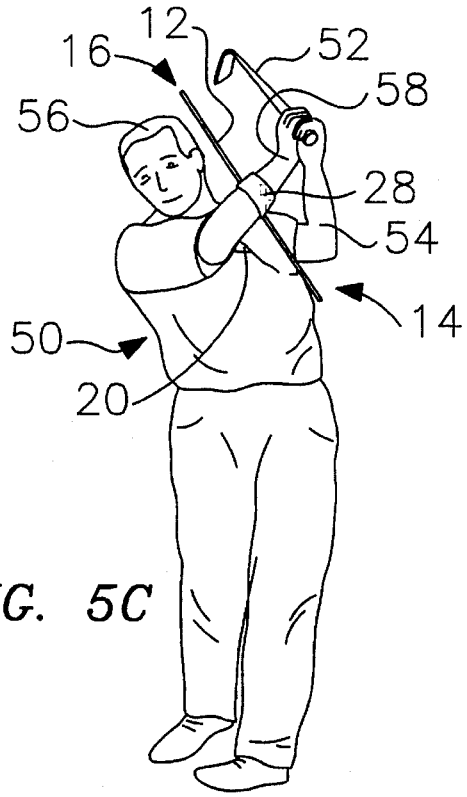

FIGS. 5A, 5B and 5C illustrate the golfer 50 with the club 52 in a full follow through portion of a golf stroke, following downswing and impact. In the follow through position of FIGS. 5A, 5B and 5C, the distance from the golfer's left pectoral muscle to the connection point on the right forearm has decreased, accommodated by sliding of at least one of the band 20 and 28 attachment points along the stick 12.

Despite the apparent simplicity of the device 10 of the invention, a number of unique and significant advantages are provided. At the outset, it should be noted that the device of the invention is applicable to virtually every golf stroke, and to a variety of different players. Players with entirely different (and even opposite) problems with their strokes are automatically corrected.

Thus, a significant feature of the invention is that it leads to a number of instant achievements by a variety of different type golfers. The improvement in the golf swing occurs essentially automatically and, through muscle memory, eventually becomes a permanent part of the golfer's swing. As examples, the outside-the-line takeaway player is forced to follow the plane of the stick, while the inside-the-line takeaway player is forced to extend as his shoulders rotate. The invention allows a player who has hand manipulation at the top of the swing to maintain a consistent transition from backswing to downswing. The autovertical player on a backswing is restricted due to the pressure created on the right forearm, while the arms only swinger is forced to rotate due to the connection of the right forearm and the left shoulder. A player who sways is forced to rotate due to the connection of the arms, chest and shoulders.

All golfers feel the right and left portions of the body moving together, and all players feel better balanced due to the chest being forced to rotate. All players feel proper club head path.

After a beginning golfer has received the slightest knowledge of the basic golf swing, the golfer is enabled to train himself with little instruction. The beginning player gains instant knowledge of the proper swing path through visualization of the stick 12, and how it is altered if movement is not rotational. Clear visualization of a proper turn in both backswing and follow through is promoted.

Although described herein primarily as a self-instructional aid, the device 10 of the invention also allows professional instructors to determine a player's errors. Thus a visual evaluation of the stick 12 position by a professional instructor allows for a quick analysis.

Beneficial results are achieved immediately, and the golfer is able to practice muscle memory while striking an actual golf ball. The golfer's muscles are trained to respond rather than to over react, and the golfer is aided in developing larger muscle movement. Club face angle is maintained, allowing the loft of each club to perform consistently.

The invention achieves these and other results through a variety of mechanisms, some relatively subtle. Thus, the extension of the stick 12 past the right forearm keeps the hands on plane. If the hands attempt to break off plane, the stick end is forced outside the left wrist. The hands are forced to stay in position and move up the inclined plane with the shoulder rotation, based on the angle of the spine.

Many golfers have a tendency to undesirably manipulate the hands. When the invention is employed, the downswing pressure is maintained on the right forearm as the left shoulder rotates upwardly, avoiding having the forearms and hand breaking down. Even the mental concentration applied to the device 10 aids in a golfer keeping the hands in a neutral position.

At impact, the hands and forearms are forced to extend. With the stick connected under and to the left pectoral muscle, as the left side of the body starts its rotation and vertical move in a downswing, the right side of the body is automatically accelerated downward, creating a more direct move back to the ball, from the side, better known as "from the inside." Due to this force, centrifugal force is created allowing the club head to stay on a more perfect circle throughout the swing.

Related to this, the follow through becomes truer, as with the stick in place a player has difficulty improperly coming "over the top", allowing the center to rotate toward the target and forcing the club head, hands and forearms, to continue down through the ball and up the follow-through circle.

During the takeaway, the player is able to check his shoulder turn. Thus, the player is enabled to see when he has made a complete and correct turn. During the takeaway, the extension of the stick 12 under the left armpit is visible in a complete backswing. When the turn is complete, the stick 12 is oriented 90° to the target, with the end of the stick pointing toward the ball.

At the same time, the force of the stick 12 on the right forearm in a downward direction causes the right elbow to fold on plane and without conscious application, allowing the golfer to feel how the right elbow collapses during a proper takeaway.

Due to the forced relationship between the left pectoral muscle and the right forearm, full shoulder rotation on both takeaway and follow through is promoted. Thus, proper hip rotation on plane and in balance due to shoulder rotation is promoted. Related to this, the device 10 forces rotation of the chest and shoulders, which causes both the inside-the-line swinger and the outside-the-line swinger to feel the proper swing plane. During the entire swing, the shoulders are kept on plane, and the right forearm is kept on plane.

As noted hereinabove, an important aspect of the invention is maintaining a constant distant relationship of the left pectoral muscle to the right forearm of the golfer to create a perfect swing plane, and correspondingly to enable the golfer to visualize this relationship. It is often difficult for a golfer to understand the actual rotation of these two points (the left pectoral and the right forearm) in the takeaway, downswing and follow through portions of a golf stroke, and the connection of these two points allows a golfer to feel, practice and develop a more perfect golf swing without formal instruction. Thus, a player is enabled to visualize the connection of these two points, and how they move as one unit. The golfer is informed, instantly, that the golf swing is a combination of a vertical and horizontal takeaway.

The benefits of the invention begin even during a golfer's set up, the address position of FIGS. 2A, 2B and 2C. Due to the angle of the stick 12, the golfer can visualize the correct right arm and shoulder position. Proper posture is created. The stick 12 position forces the golfer to stand upright, causing the spine to become erect. The angled stick 12 creates the mental impression of a left to right tilt, which results in a proper setup of the right and left shoulder and right forearm.

During the takeaway portion of the golf stroke, the left pectoral muscle and right forearm must remain a constant distance apart. In order to maintain this constant distance, the right elbow must bend as the left shoulder rotates. A one piece takeaway is promoted, as the shoulders, arms and forearms are all controlled.

On the downswing, the same occurs in reverse order, which creates a more direct move down the inclined plane. Thus, as the right forearm is led or forced downward toward the ball by pressure of the stick resulting from movement of the left lead arm and left pectoral muscle, the right elbow starts to straighten or extend. To maintain the equal distance relationship between the left pectoral muscle and the right forearm, the left shoulder rotates in a vertical and horizontal motion to allow the right forearm to extend fully at impact, again maintaining the constant distance relationship between the left pectoral muscle and the right forearm at impact.

As noted hereinabove, the device 10 of the invention is applicable to all golf strokes, including full swing, short swing, chipping, and putting, and maintains consistent hand pressure throughout all these swings. The device 10 makes a golfer's hands stay connected through impact on both short and full swing strokes.

During chipping practice, when performing a normal knock-down, off the right foot chip shot, the stick 12 ends up parallel to the left arm of the golfer and parallel to the golf club shaft.

For putting practice, the stick 12 may be applied in a variety of ways, and aids to promote a shoulder stroke in contrast to an undesirable hand stroke. Thus, the arm connection end of the stick can be attached to the right forearm, above the right elbow, and even below the right arm above the right elbow. The other end of the stick can be attached under the left armpit as is normally the attachment for a full stroke, or outside the left arm.

In any event, at address, an imaginary line drawn from the direction of the target should pass through the shaft of the golf club and the extension of the stick 12. Among other things, this promotes proper shoulder alignment due to visualization of the stick. Other putting practice benefits include the promotion of a better set up with eyes over the intended putting line and slightly behind the ball. With hands neutral during a putting stroke, the putter head and stroke stay on a vertical plane.

The stick 12 position of FIGS. 2A through 5C is particularly beneficial for a golfer who is working on developing a proper swing plane, as well as firm wrists.

Figure 6:
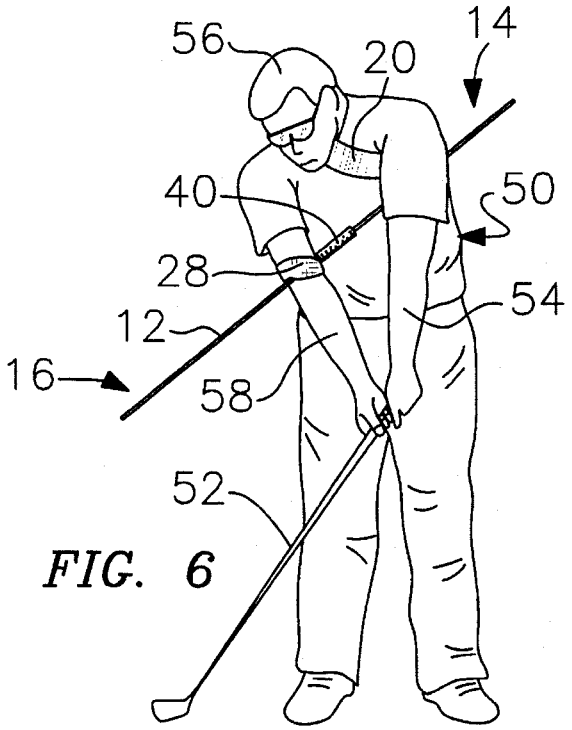
FIG. 6 is a view of a golfer with the training device of the invention applied to an alternate arm attachment point, the view of FIG. 6 being in the same orientation as that of FIG. 2A.
Figure 7:
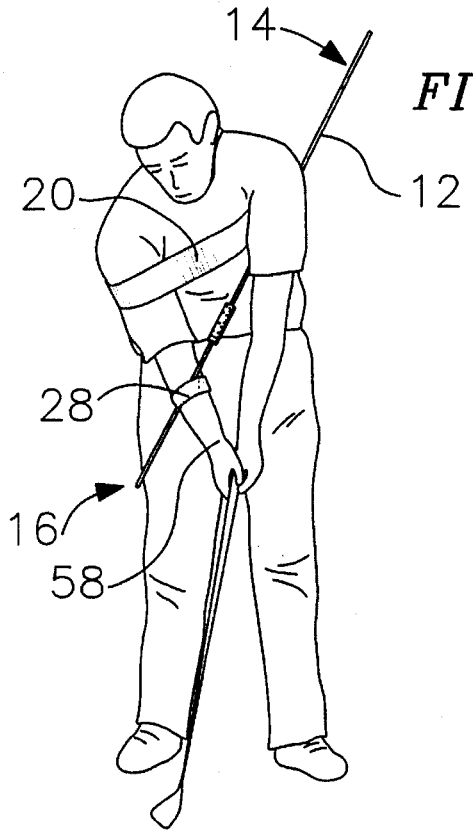
FIG. 7 is a view of a golfer wearing a training device of the invention, wherein the relatively larger band extends under the left armpit and around the outside of the right arm of the golfer, the view of FIG. 7 being in the same orientation as that of FIG. 2A.

For a golfer working on turning, or who has a "flying elbow", the alternative positions of FIGS. 6 and 7 are beneficial. In FIG. 6, the stick 12 portion 26 is connected to the upper arm of the golfer, above the right elbow (assuming a right-handed golfer). This position forces the right elbow to bend or fold on plane quickly.

The configuration of FIG. 7 accomplishes a similar result. In FIG. 7, the relatively larger band 20 is sized to extend generally under the left armpit and around the outside of the connected arm of the golfer, the right arm in the case of a right-handed golfer. This keeps the right arm close to the body for a more "connected" swing, and again forcing the right elbow to bend or fold on plane quickly during the takeaway.

Figure 8:
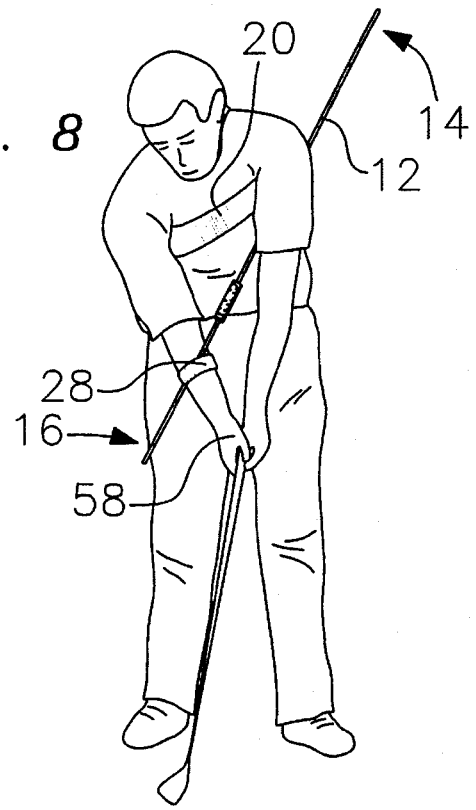
FIG. 8 is a view of a golfer wearing a training device of the invention, wherein the relatively larger band extends around the chest of the golfer, the view of FIG. 8 being in the same orientation as that of FIG. 2A.

FIG. 8 illustrates another alternative position, where the relatively larger pectoral connection band extends around the chest of the golfer 50, rather than around the neck as in FIGS. 2A through 6. The FIG. 8 position may be preferred by some golfers. The functioning is essentially the same as the around-the-neck positioning of FIGS. 2A through 6.

Figure 9:
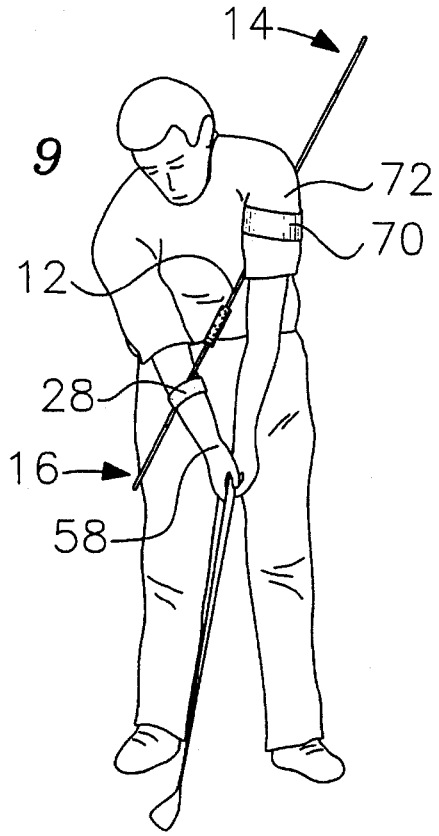
FIG. 9 is a view of a golfer wearing an alternative embodiment of a training device in accordance with the invention, wherein an upper arm connection band is employed, the view of FIG. 9 being in the same orientation as that of FIG. 2A.

Referring finally to FIG. 9, an alternative embodiment of the invention, rather than the pectoral connection band 20 around the chest or neck of the golfer, employs an upper arm connection band 70. Thus attached to the stick 12 are the arm connection band 70, also referred to herein as the first band, and a forearm connection band 28, unchanged from the arm connection band previously described, and also referred to herein as the second band.

The function of the embodiment of FIG. 9 is similar to that of FIGS. 2A through 5C because the left upper arm 72, particularly in the armpit area, is closely linked to the left pectoral muscle, with little relative movement between these two points.

While preferred connection techniques have been illustrated and described herein, it will be appreciated that the device of the invention may be attached to the golfer in various ways. Thus, and as illustrated in FIG. 8, the relatively larger band, while normally extending around the neck of the golfer, may extend around the chest of the golfer, with similar results. As illustrated in FIG. 7, the relatively larger band may extend around the upper portion of the right arm. The arm connection end of the stick may be connected to the right arm of the golfer in a variety of positions, with different subtle results. As examples, the stick may be connected either on top of or below the arm, and either above or below the elbow. These various connection options will correspondingly result in different angles of the stick 12.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A golf swing training device comprising:

an elongated rigid shaft having two ends;

a relatively larger band attached to a first portion of said shaft near one end of said shaft for generally connecting said first portion to the pectoral muscle of a golfer on the side of the golfer generally facing the intended direction of golf ball travel while the golfer is addressing the ball, said shaft extending from said first portion generally under the armpit of the golfer towards said one end while the golfer is addressing the ball;

a relatively smaller band attached to a second portion of said shaft near the other end of said shaft for generally connecting said second portion to a portion of the arm of the golfer on the side of the golfer generally facing away from the intended direction of golf ball travel while the golfer is addressing the ball, said shaft extending from said second portion past the connected arm of the golfer towards said other end while the golfer is addressing the ball;

whereby the pectoral muscle and the connected portion of the arm of the golfer are maintained a substantially constant distance apart during the takeaway, downswing and impact portions of a golf swing; and at least one of said bands being slidable along said shaft to accommodate relative movement of the pectoral muscle and the connected portion of the arm of the golfer during the follow through portion of the golf stroke.

2. The golf swing training device of claim 1, wherein at least said relatively larger band is elastic.

3. The golf swing training device of claim 1, wherein said relatively larger band is sized to extend generally under the armpit and around the neck of the golfer.

4. The golf swing training device of claim 1, wherein said relatively larger band is sized to extend generally around the chest of the golfer.

5. The golf swing training device of claim 1, wherein said relatively larger band is sized to extend generally under the armpit and around the outside of the connected arm of the golfer.

6. The golf swing training device of claim 1, wherein said relatively smaller band is adapted to generally connect said second portion of said shaft to the forearm of the golfer.

7. The golf swing training device of claim 6, wherein said relatively smaller band is adapted to generally connect said second portion of said shaft to the top of the forearm of the golfer.

* * * * *